US008968098B2

(12) United States Patent
Harari

(10) Patent No.: US 8,968,098 B2
(45) Date of Patent: Mar. 3, 2015

(54) METHOD AND APPARATUS FOR ONLINE GAMING ON TERMINALS

(75) Inventor: Sagi Harari, Douglas (GB)

(73) Assignee: Videob Holdings Limited, Douglas (GB)

( * ) Notice: Subject to any disclaimer, the term of this patent is extended or adjusted under 35 U.S.C. 154(b) by 51 days.

(21) Appl. No.: 13/489,328

(22) Filed: Jun. 5, 2012

(65) Prior Publication Data

US 2012/0244943 A1 Sep. 27, 2012

Related U.S. Application Data

(63) Continuation of application No. 12/444,636, filed as application No. PCT/IB2006/053781 on Oct. 15, 2006, now abandoned.

(51) Int. Cl.
*A63F 9/24* (2006.01)

(52) U.S. Cl.
USPC ..... 463/42

(58) Field of Classification Search
USPC ..... 463/42; 725/82
See application file for complete search history.

(56) References Cited

U.S. PATENT DOCUMENTS 5,397,133 A 3/1995 Penzias
6,508,709 B1 1/2003 Karmarkar
6,544,126 B2 * 4/2003 Sawano et al. ..... 463/42
6,575,834 B1 6/2003 Lindo
2002/0068635 A1 6/2002 Hill
2005/0159212 A1 7/2005 Romney et al.
2006/0135238 A1 6/2006 Lancaster et al.

FOREIGN PATENT DOCUMENTS

WO WO 2004/063841 A2 7/2004

OTHER PUBLICATIONS

International Search Report mailed Feb. 27, 2008 for PCT/IB06/53781.
Written Opinion mailed Feb. 27, 2008 for PCT/IB06/53781.
Dec. 5, 2011 Office Action issued in U.S. Appl. No. 12/444,636.
"A Case for End System Multicast", Yang-hua Chu, et al., IEEE Journal on Selected Areas in Communications, vol. 20, No. 8, Oct. 2002, pp. 1456-1471.

* cited by examiner

*Primary Examiner* — Yu-Hsi D Sun
(74) *Attorney, Agent, or Firm* — Oliff PLC

(57) ABSTRACT

A method and apparatus for enabling a player to participate in a live online game via a landbased gaming terminal. A game manager is playing the game while being captured for example by a video camera. A player participates in the game through using the landbased gaming terminal, which presents the image stream and lets the player make selections and perform actions for participating in the game.

19 Claims, 5 Drawing Sheets

METHOD AND APPARATUS FOR ONLINE GAMING ON TERMINALS

This is a Continuation of Application Ser. No. 12,444,636 filed Apr. 7, 2009, which claims the benefit of PCT International Application No. PCT/IB 2006/053781 filed Oct. 15, 2006. The disclosure of the prior applications is hereby incorporated by reference herein in its entirety.

BACKGROUND OF THE INVENTION

1. Field of the Invention

The present invention relates to a method and apparatus for gaming in general, and to live online gaming on landbased terminals in particular.

2. Discussion of the Related Art

Online gaming generally refers to games a player plays from a computer, such as a personal computer or a network computer, from the home, office, Internet café or another accessible computer. The player plays either against a computer or against other players. A special segment of online games is live online games, in which the player sees a flash-and-blood game manager or operator, such as a dealer. In such games, part of the display seen by the user preferably shows the game manager and optionally enables communication with such manager. Another part of the display preferably shows an illustration of the game which reflects the updated state of the game, choices made by the player, and optionally financial balance, choices made by other players, or other information. Other optional parts include computerized display of events or actions taken by the game manager, for example a computerized (rather than a pictorial) display of a card, a state of a machine, or the like. Participating in an online live game provides enhanced excitement to a player, who gets the feeling of a playing in a real playing room rather than alone, without the bother, time consumption and other limitations of physically going to such room.

However, online games, including live ones, require a player to provide credit card details, which many potential players are reluctant to do. In addition, many players such as those playing form their office do not wish to leave traces of visiting gaming sites on a computer and might therefore avoid playing online games. Another drawback of online games played on a computer relates to the limited abilities of such computer to cater for the need of games, including limited bandwidth for transferring a good quality audio stream, limited resolution and sub optimal input devices, usually including a mouse and a keyboard.

There is therefore a need for a solution that will provide the excitement and options available to a player playing in a real gaming room, including seeing the game manager, without visiting an actual game room, while avoiding also the limitations inherent to using a computer for participating in an online live game.

SUMMARY OF THE PRESENT INVENTION

The present invention provides a novel method and apparatus for providing online gaming on terminals.

In an exemplary embodiment of the present invention, enabling a player using a landbased terminal to view and participate in an online game. The player preferably sees the game manager, selects options and wins or looses according to his selections and the course of the game.

There is thus provided in accordance with an exemplary embodiment of the disclosed invention an apparatus for enabling one or more players to participate in one or more live online games, the apparatus comprising one or more gaming rooms, the gaming room comprising equipment for playing the live online game and one or more cameras for capturing one or more image streams; one or more game servers communicating with the gaming room for administrating the live online game; one or more broadcasting servers for transferring the image streams; and one or more first landbased gaming terminal communicating with one or more of the game servers, the landbased gaming terminals used by the players to participate in the live online games, the landbased gaming terminals receiving the image streams transferred from the broadcasting server. Optionally, the gaming room further comprises an encoder server for encoding the image streams. Optionally, the gaming room further comprises a computing platform running an operator applet. Within the apparatus, the gaming location can further comprise equipment for computerizing one or more aspects of the live online game. The one or more aspects are optionally presented on the landbased gaming terminal. The equipment is optionally a scanner. The apparatus optionally comprises one or more second landbased gaming terminal for receiving the image streams from the broadcasting server, and transferring the image stream to the first landbased gaming terminal. Optionally, the image stream is decoded at a second landbased gaming terminal. Optionally, the first landbased gaming terminal shows the image stream in a first window, or the first landbased gaming terminal shows additional information in the first window or in a second window. The additional information can be an illustration of the live online game. Optionally, the image stream is compressed or encoded at the game server and decompressed or decoded, respectively, at the landbased gaming terminal. Within the apparatus the first landbased gaming terminal can comprise a microphone or a loudspeaker for enabling the players to chat with a game manager.

Another aspect of the disclosed invention relates to a method for enabling one or more players to participate in one or more live online games, the method comprising the steps of playing a game in a gaming location; capturing the game into an image stream; transferring information from the live online game to a game server; transferring the information from the game server to one or more first landbased gaming terminals; transferring the image stream to a broadcasting server; transferring the image stream from the broadcasting server to the first landbased gaming terminal; the players participating in the live online game at the first landbased gaming terminal, while the image stream and information of the game is presented to the players; and transferring information about one or more actions of the players to the game server. The method can further comprise a step of the players chatting with a person managing the live online game. The method optionally comprises a step of recording the image stream, or a step of transferring the image stream from the first landbased gaming terminal to one or more second landbased gaining terminals. The method optionally comprises the steps of encoding the image stream and decoding the image stream.

BRIEF DESCRIPTION OF THE DRAWINGS

Non-limiting embodiments of the invention will be described with reference to the following description of exemplary embodiments, in conjunction with the figures. The figures are generally not shown to scale and any sizes are only meant to be exemplary and not necessarily limiting. In the figures, identical structures, elements or parts that appear in more than one figure are preferably labeled with a same or similar number in all the figures in which they appear, in which.

DETAILED DESCRIPTION OF THE PREFERRED EMBODIMENT

Figure 1:
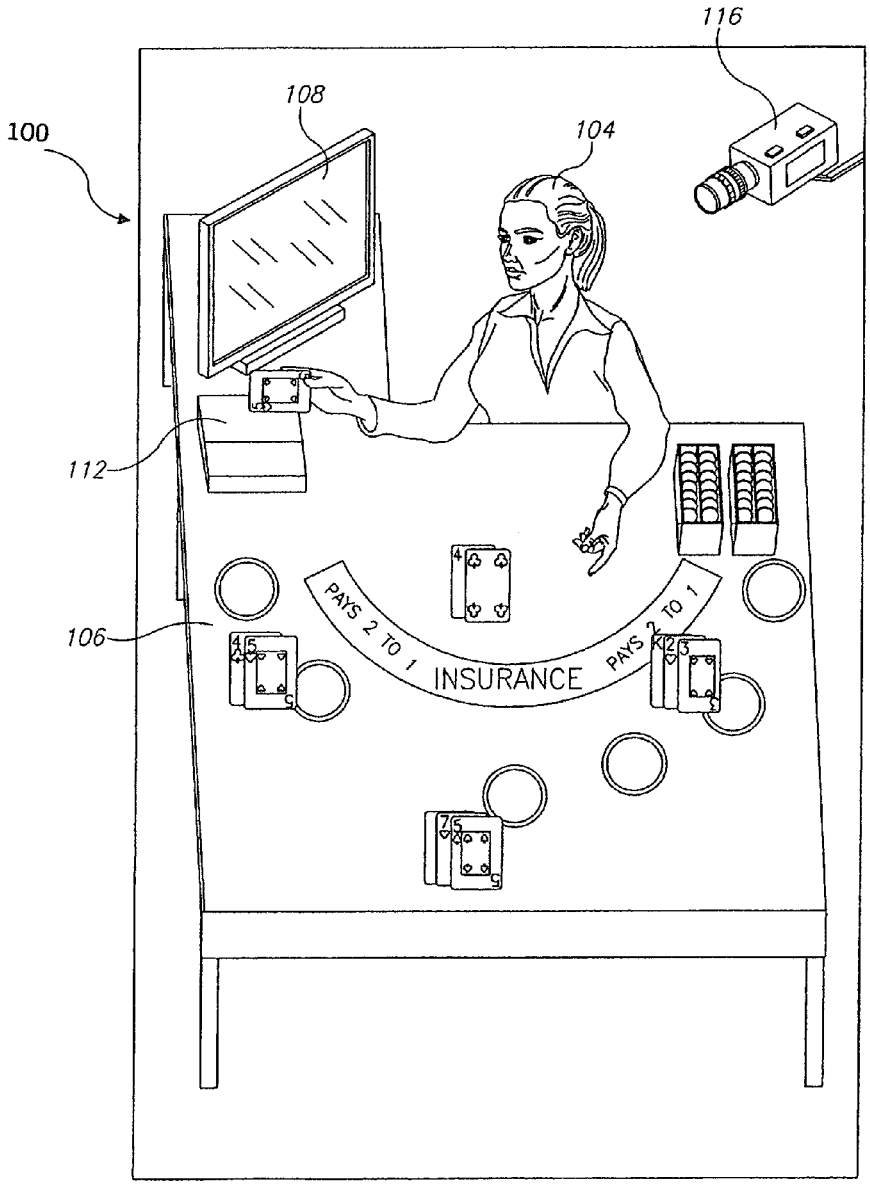
FIG. 1 is a schematic illustration of a game manager playing a game, in accordance with a preferred embodiment of the disclosed invention.

The present invention overcomes the disadvantages of the prior art by providing a novel solution which enhances and adds to the capabilities of currently available live online games, and discloses a landbased gaming terminals running live online games.

In a preferred embodiment of the disclosed invention, a game manager or a game operator is playing a game in a predetermined location, preferably a gaming room. The game manager can be the dealer of cards in such games where cards are being dealt, or have another managerial or supervisory role in the game in playing. In other embodiments the game manager would be an operator of the game facilities necessary to have the game conducted in the setting described herein. In addition to the equipment required for the game, equipment for computerizing one or more aspects of the game is supplied at the gaming room, for example a scanner for scanning a card drawn by the game manager and computerized device for determining which card is drawn based on the scanned image. In the preferred exemplary embodiment, the location also comprises a capturing device such as a video camera, for capturing an image stream. The game manager is managing the playing of the game in a normal manner, while using the computerizing equipment to capture one or more aspects, such as presenting a drawn card to the said scanner. The camera, such as the video camera captures an image stream of the scene, and preferably transfers it to a computing platform present at the gaming room. The computing platform then transfers the compressed stream to a broadcasting server. Alternatively, the captured stream is transferred to the broadcasting server as is, and the broadcasting server performs the compression of the stream. Analogously, the information captured by the computerizing equipment and additional information related to the game is transferred to a game server. The game server and the broadcasting server can be co-located on the same computing platform, on separate computing platforms located on the same place or on geographically apart computing platforms. The game server and the broadcasting server comprise at least a communication device and a computing device to capture, store and send information associated with the said game. The broadcasting server and the game server send the video stream and the information, respectively, to one or more gaming terminals used by one or more players. The gaming terminals can be placed in any desired location, preferably remote, including casinos, gas stations, hotel lobby, shopping malls or anywhere else. Players accessing the terminals pay with any of the standard mechanisms accepted by the terminal including coins, bills, credit cards, vouchers purchased from a cashier, or the like. A player is preferably presented with one screen or window playing the video stream showing the game manager and possibly the additional information, and with a second screen or window showing an illustration of the current state of the game. The reference to screen or window is referring in the present application to a part of the graphical user interface shown to the player. The player plays the game by using suitable buttons, levers, handles, touch screen buttons or other mechanisms offered by the terminal or peripherals attached thereto, also through selection of one or more options associated with the game. Preferably, in an alternative exemplary embodiment of the invention, the stream showing the game undergoes a compression or encoding process, either at the gaming room or at the backend, or at another location there between, and decompression or decoding, respectively, at the terminal. In a preferred embodiment of the disclosed invention, if an operator operates multiple terminals in the same physical location, the video stream, whether compressed or not, is preferably transferred once from the broadcasting server to a landbased terminal, and then distributed from the landbased terminal to additional co-located landbased terminals, rather than distributed from the broadcasting server to each terminal separately. Yet, it is possible to transfer the stream to each terminal separately, in order to keep its independence and avoid shutdown of all the terminals if the server is malfunctioning. If the video stream is compressed, it can be decompressed at the terminal to which it is sent from the broadcasting server and transferred uncompressed to the additional servers. Alternatively, the stream is transferred compressed and decompressed only at a terminal on which it is displayed.

Reference is now made to FIG. 1, showing the gaming room, generally referenced 100. Game manager 104 manages a game 106 in an ordinary manner within gaming room 100, but unlike ordinary gaming room, the game is not limited to players physically present at gaming room 104, rather players located at a remote location to said playing room can participate in the game. Moreover, a game can take place even if no player is present at gaming room 104, and only remote players are participating in the game. In order to communicate with remote players, game manager 104 uses a computer such as a personal computer or a network computer. The computer, showing on a display 108 information and enabling communication with remotely located players. In addition, game manager 104 uses specialized equipment such as a scanner 112 to provide information to a possibly remote game server (not shown). In the scene shown in FIG. 1, game manager 104 passes each drawn card through scanner 112. Scanner 112 passes the image to the game server, which processes the image and determines which card was drawn. If a different game is played rather than a card game, scanner 116 can be replaced with another type of equipment, for example equipment for computerized determination of the result of a roulette round. In addition, a video camera 116 is capturing game manager 104 together with game 106, and passes the stream to a broadcasting server (not shown). In another preferred embodiment, there are multiple video cameras, capturing game manager 104 and game 106 from different angles, and sending multiple streams of said game to the to a broadcasting server.

Figure 2:
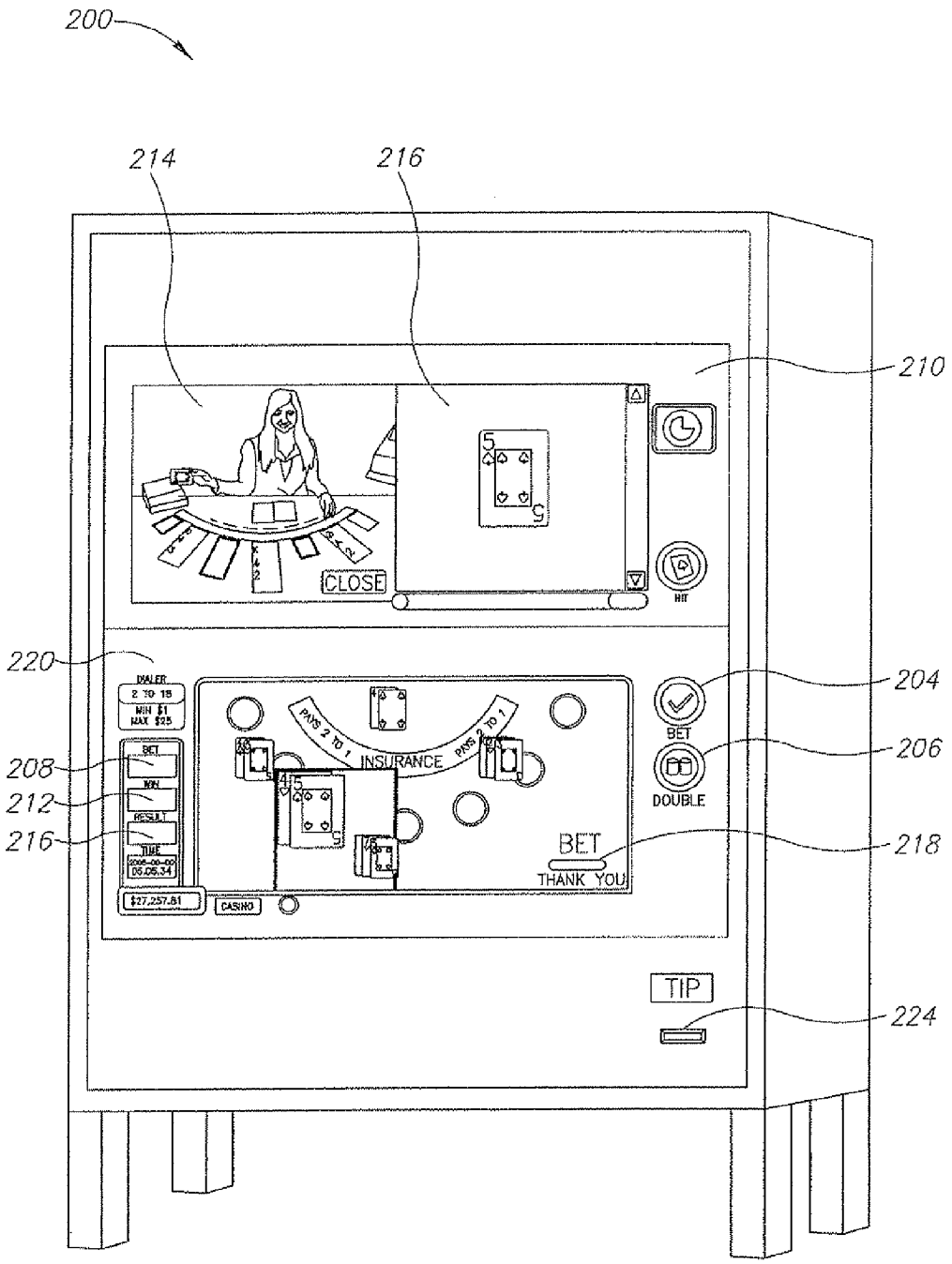
FIG. 2 is an illustration of a landbased gaming terminal when a roulette game is enabled, in accordance with the preferred embodiment of the disclosed invention.

Referring now to FIG. 2, showing a landbased gaming terminal of a card game, according to the disclosed invention. The gaming terminal, generally referenced 200 comprises standard buttons for performing actions associated with the game such as bet button 204 or double button 206, displays for providing indications about the game to a player such as bet display 208, win display 212 or result display 216, and other elements, such as betting slot 218. Terminal 200 preferably further comprises two screens, an upper screen 210 and a lower screen 220. Upper screen 210 further comprises two windows. Left hand window 214 displays the video stream taken by camera 116 of FIG. 1, showing game manager 104 and game 106 and, and right hand window 216 showing the card as scanned by scanner 112 of FIG. 1 and analyzed by the game server. Alternatively, one of windows 214, 216 is a zoomed view of the other one, for example one window shows the game manager while the other zooms on the drawn card or a computerized presentation thereof. The zoomed picture can be displayed in a continuous manner, or only at selected times, for example when a card is drawn. In yet another alternative, only one stream is displayed, showing the game manager, and switching to the zoomed one at times, for example when a card is drawn. Lower screen 220 shows a computerized illustration of the ongoing game, including the cards drawn by the game manager, the cards assigned to the player and other relevant information. The terminal further comprises a slot 224 for inserting coins as tip for the game manager. In alternative exemplary embodiment of the present invention, the gaming terminal can comprise one or more touch screen display on which said buttons, 204, 206, 208, are graphically represented. Likewise in such exemplary alternative embodiments the other elements and the screens 214, 216, 218 that are used to play the game can also be graphically represented, each on a portion of the touch screen display. According to this exemplary embodiment the touch screen display is configured such that the areas representing buttons are programmed to produce the same commands to be sent to the gaming server (element 404 of FIG. 4) when the player so touches the screen at the appropriate location. For example, when the player (not shown) touches the respective area over bet button 204, an appropriate command is sent to said gaming server such that will indicate that the player has placed his bet. The use of touch screen display will enable the game server to further add or delete buttons or parts of the display so as to enable a more complex or simple presentation of the progress of the game. The addition or deletion can be performed either constantly or dynamically as the game evolves Thus, for example, if the game manager determines at a certain point in time that no more bets can be placed, and such suitable command has been transferred from the game manager to the game server, the game server may indicate to the gaming terminal to remove said bet button 204 from the screen or display a sign on or in connection with said button that indicates that no more bets are allowed.

Figure 3:
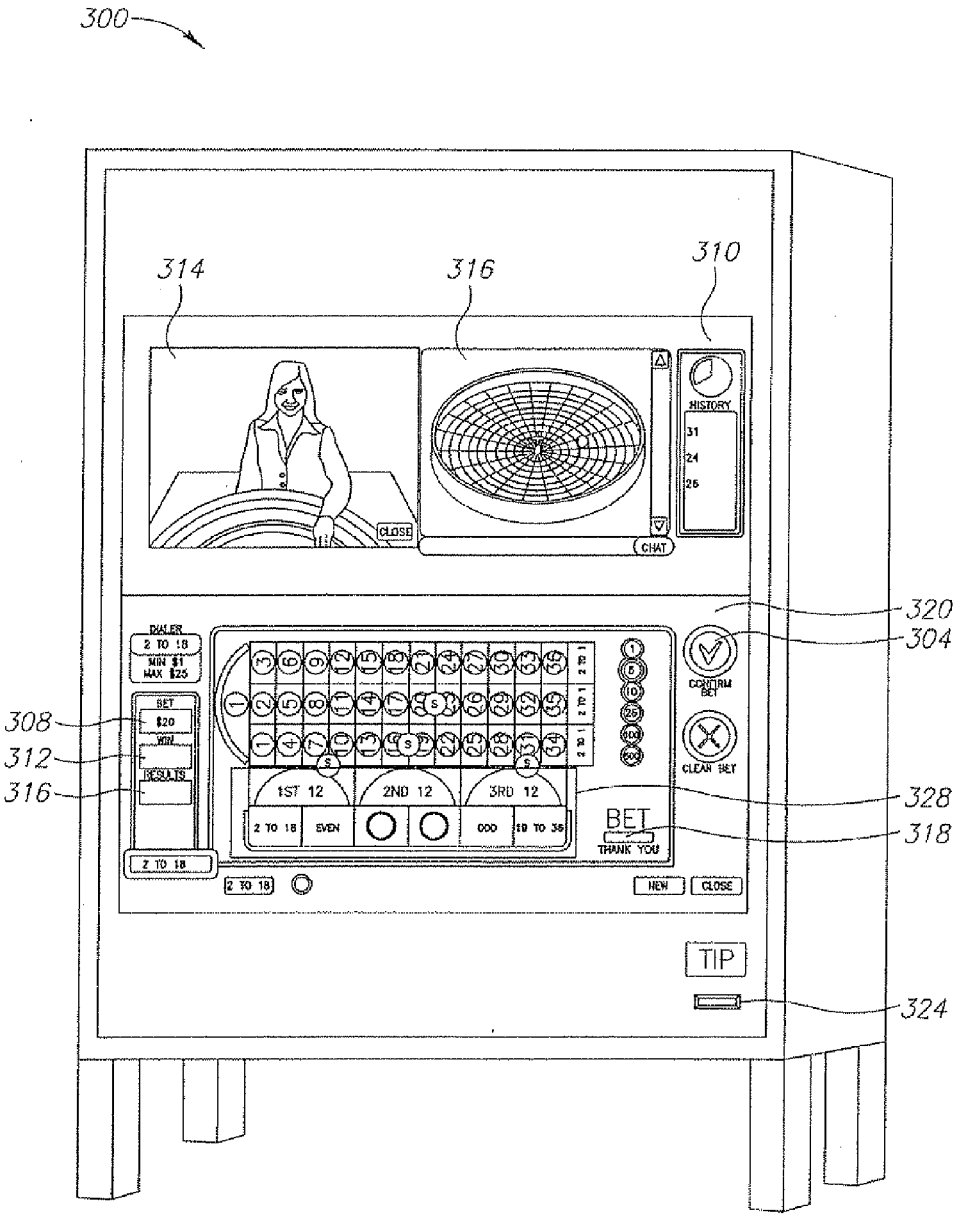
FIG. 3 is an illustration of a landbased gaming terminal when a card game is enabled, in accordance with the preferred embodiment of the disclosed invention.

Referring now to FIG. 3, showing a landbased gaming terminal of a roulette game, according to the disclosed invention. The gaining terminal, generally referenced 300 comprises standard buttons for performing actions associated with the game such as bet conformation button 304, displays for providing indications about the game to a player such as bet display 308, win display 312 or result display 316, and other elements, such as betting slot 318. Terminal 300 preferably further comprises two screens, an upper screen 310 and a lower screen 320. Upper screen 310 further comprises two windows: left hand window 314 displays a video stream such as the stream taken by camera 116 of FIG. 1, showing a game manager playing a roulette game, and right hand window 316 showing information relevant to the roulette game, such as a computerized presentation of the winning number in the roulette. Alternatively, one of windows 314, 316 is a zoomed view of the other one, for example one window shows the game manager while the other zooms on the roulette wheel. The zoomed picture can be captured in a continuous manner, or only at selected times, for example when the roulette stops. In yet another alternative, only one stream is displayed, showing the game manager, and switching to the zoomed one at times, for example when a card is drawn. Lower screen 320 shows a computerized illustration of the ongoing roulette game, including the current player bets. Using touch buttons 328 on lower screen 320 the player can make his or her decisions for the game, and confirm the bet with confirm bet button 304. The terminal further comprises a slot 324 for inserting coins as tip for the game manager. In alternative exemplary embodiment of the present invention, the gaming terminal can comprise a single touch screen display on which said buttons, 304, 306, 308, so are graphically represented. Likewise in such exemplary alternative embodiments the other elements and the screens 310, 314, 316, 328 that are used to play the game, can also be graphically represented each on a portion of the single touch screen display. According to this exemplary embodiment the touch screen display is configured such that the areas representing buttons are programmed to produce the same commands to be sent to the gaming server (element 404 of FIG. 4) when the player so touches the screen at the appropriate location. For example, when the player (not shown) touches the respective area over confirm bet button 304, an appropriate command is sent to said gaming server such that will indicate that the player has placed his bet. The use of touch screen display will enable the game server to further add or delete buttons, or parts of the display so as to enable a more complex or simple presentation of the progress of the game. The addition or deletion can be performed either constantly or dynamically as the game evolves. Thus, for example, if the game manager determines at a certain point in time that no more bets can be placed, and such suitable command has been transferred from the game manager to the game server, the game server may send the gaming terminal an instruction to then to block the slot for entering the bet wager. Such blockage can be performed in an exemplary embodiment through the use of a rigid material being moved to physically close the slit through money is deposited with the gaming terminal.

It would be appreciated by a person skilled in the art that the gaming room shown in FIG. 1 can be captured by multiple video cameras such as 116. A player of a terminal can then be presented with a selection among multiple video streams. Alternatively, window 214 of FIG. 2 or 314 of FIG. 3 can be divided into two or more sub windows, wherein each sub window displays a stream captured by another camera. It will also be appreciated that the windows shown in FIG. 2 and FIG. 3 can be resized, moved, their order can be changed, and alternative or additional information can be displayed. It will further be appreciated that a gaming terminal as shown in FIG. 2 or FIG. 3 can comprise a single screen, presenting any one or more of the following views: a computerized presentation of the game, a stream of the game manager, a zoomed stream of a relevant part, such as a roulette wheel, or a computerized presentation of an aspect associated with the game such as a drawn card. Any one or more of the views can be presented continuously, at times, be replaced with each other, appear at changing positions or sizes on the screen, or the like, without deviating form the spirit of the disclosed invention.

Figure 4:
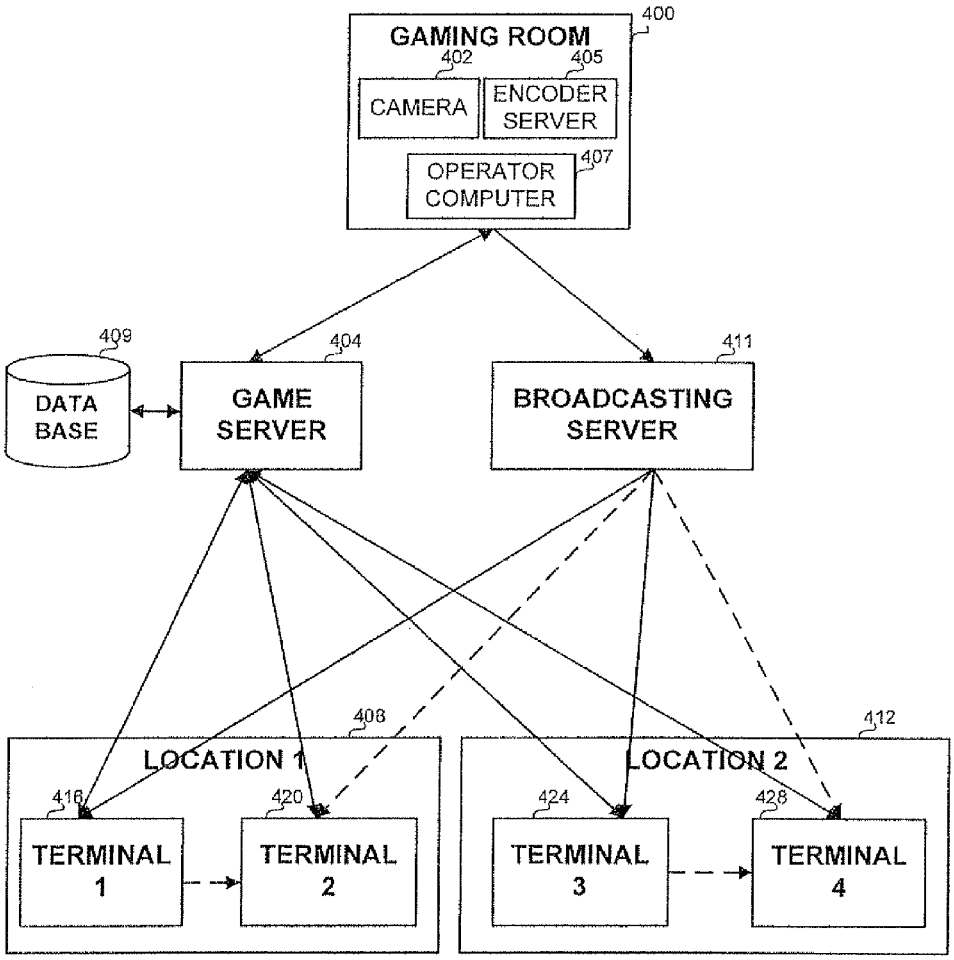
FIG. 4 is a block diagram of an apparatus of a live game on terminal, in accordance with the preferred embodiment of the disclosed invention.

Reference is now made to FIG. 4, showing a gaming network, in accordance with a preferred embodiment of the disclosed invention. In a first gaming room location, such as a gaming room 400, and/or in additional gaming rooms (not shown), one or more games are taking place. Gaming room 400 comprises a video camera 402 as shown in FIG. 1, an encoder server 405 and an operator computer 407 running an operator applet, which provides the operator with control over the game. Encoder server 405, which is preferably a computing platform running an encoding application is responsible for encoding, for example for compression purposes the video stream taken by camera 402. The information from the gaming room related to the logic of the game, such as the cards drawn by the operator, the commands to the terminals (for example "no more bets") and the like are transferred from gaming room 400 to game server 404, which administrates and handles the logic of the game, including decisions for which player won or lost and how much, or other issues related to the game. Game server 404 is in communication with data base 409, which stores information related to games, players, locations and other information. Game server 404 stores and retrieves information from data base 409. Concurrently, the video stream as captured by camera 402 and compressed by encoder server 405 is transferred to broadcasting server 411, which can be located at or near gaming room 400, or anywhere else. Game server 404 and broadcasting server 411 can be separate computing platforms or co-located on the same computing platform. Gaming room 400, game server 404 and broadcasting server 411 are preferably connected via a communication network such as a local area network, a wide area network, the Internet, or the like. Game server 404 transfers the commands or updates related to the logic of the game to each terminal in each location where the game is played. Each location is a physical location, such as a hotel, airport, a gaming hall or other locations hosting one or more landbased gaming terminals, such as those shown in FIG. 2 or FIG. 3. The gaming terminals can be placed in literally any location having a wired or wireless connection to the Internet through which connection is possible to the game server 404. For example, the data is transferred to terminal 1 (416) and terminal 2 (420) in location 1 (408), and to terminal 3 (424) and terminal 4 (428) in location 2 (412). Each of gaming room encoder server 405, game server 404, broadcast server and terminals 416, 420, 424, 428 the first location server 408, the second location server 412, is preferably a in computing platform, such as a network computer, a personal computer, a mainframe computer, or any other type of computing platform that is provisioned with a memory device (not shown), a CPU or microprocessor device, one or more communication devices, and several I/O ports (not shown). Alternatively, any of said servers or terminals can be a DSP chip, an ASIC device storing the commands and data necessary to execute the methods of the present invention. Data from terminals 416, 420, 424, 428, related to the player's options, selections, bets or other actions is optionally transferred to game server 404, from there to gaming room 400, and presented to the game manager through operator applet 407. Gaming room 400 may optionally store the information in database 409. The encoded video stream is transferred from broadcasting server 411 to one or more terminals within each location, such as location 1 (408) or location 2 (412). In a preferred embodiment, the encoded video stream is transferred to one terminal, such as terminal 1 (416) within location 1 (408), and then transferred internally within the location to other terminals, such as terminal 2 (420), and similarly within location 2 (412). In another preferred embodiment, the video stream is transferred from broadcasting server 411 separately to each terminal in each location, including terminals 416, 420, 424 and 428. The first embodiment, in which the stream is transferred once to each location provides lower bandwidth consumption, but creates a dependency on a specific terminal within each location. Preferably, each terminal receiving the video stream decodes the video stream and presents it on the display, as described in association with FIG. 2 and FIG. 3 above. Alternatively, if the stream is transferred to a single terminal within each location, the receiving terminal can decode the stream and transfer the decoded stream to the other terminals within the location. Either game server 404 or one or more terminals within each location determine which game is shown and enabled on which terminal(s). Such determination can be made according to a plurality of factors, including, but not limited too, bandwidth, time of day, the availability of network resources, distribution of games, active games at each location, profit earning from each game, demand for each game, expected number and characteristics of players, and others. A terminal within each location can determine the enabled games according to a policy of distribution of games between and within locations, time of day, agreements with operators or any other factor. Alternatively, the determination can be left to a player, who will be presented with an opening screen suggesting the available games. Information from terminals 416, 420, 424, 428 relating to choosing a game are optionally also passed from the terminals to game server 404, and from there to gaming room 400 or to other gaming rooms, including even gaming rooms for different games.

Figure 5:
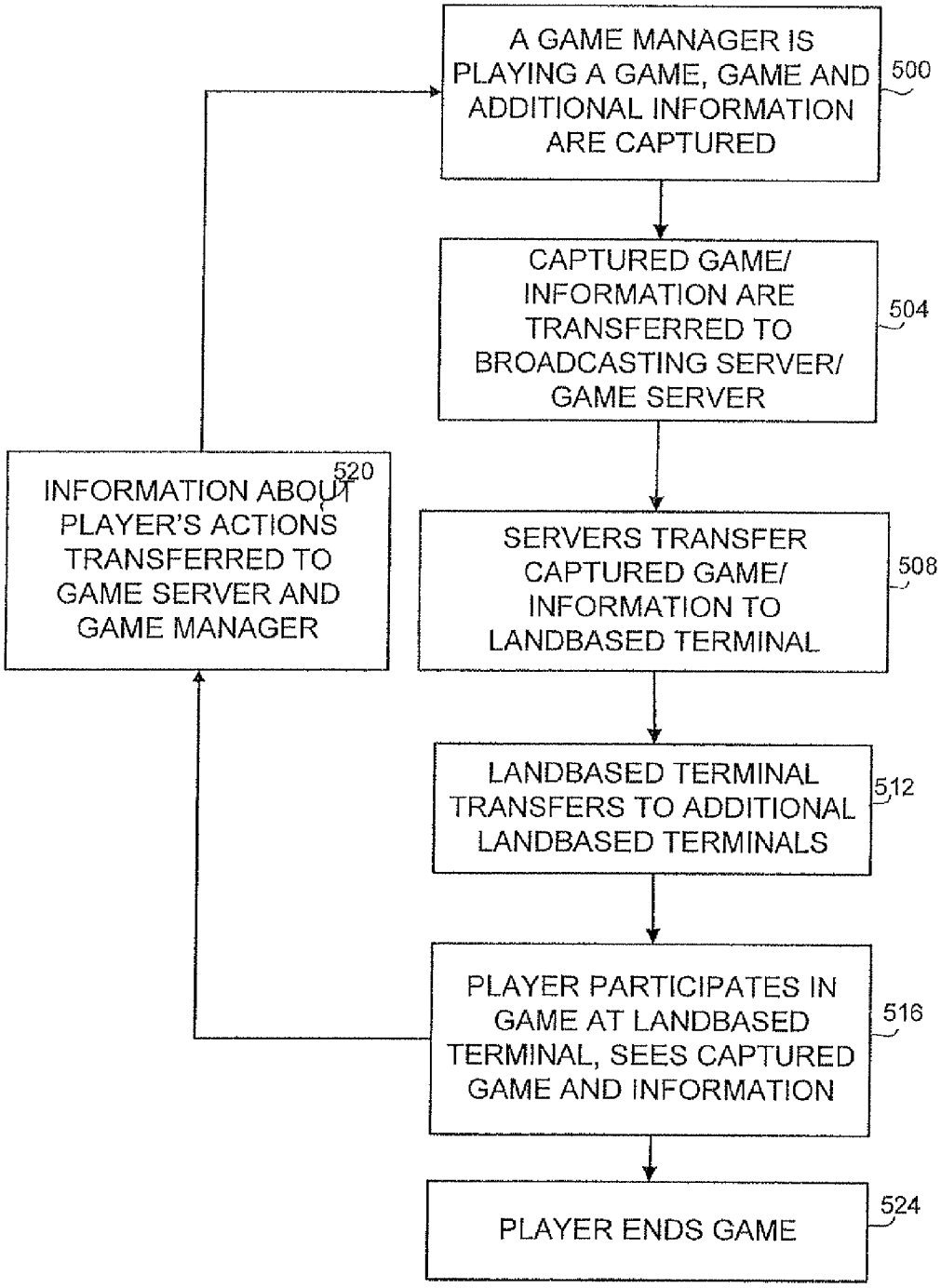
FIG. 5 is a flowchart of the main steps associated with enabling a live game on terminal, in accordance with the preferred embodiment of the disclosed invention.

Reference is now made to FIG. 5, showing a schematic flowchart of the method of the disclosed invention. At step 500 a game manager is managing a game in a gaming room. The game, with or without the game manager, and possibly additional information such as scanned cards are captured by devices such as a video camera capturing a video stream, a scanner, or the like. The game manager receives during the game information about players at remote locations, and their actions. At step 504 the captured video stream is transferred to broadcasting server 411 of FIG. 4. The video stream optionally undergoes compression at a computing platform in the gaming room, prior to being sent to broadcasting server 411 of FIG. 4, or at broadcasting server 411 of FIG. 4. Also at step 504, additional information relevant to the game is transferred to game server 404 of FIG. 4. At step 508, broadcasting server and game server transfer the captured (and possibly compressed) stream and the additional information, respectively, to landbased terminals. Preferably, the stream and the information are sent to one landbased terminal in each physical location in which the games are played, but they can also be transferred to multiple landbased terminals in one or more locations. At step 512 a landbased terminal that received the stream or the information transfers said stream or information to additional landbased terminals, preferably those located in proximity to the receiving terminal. Alternatively, the video stream is distributed as described above through one terminal in each location in order to save bandwidth, while the additional information is transferred directly from the game server to each terminal. In one preferred embodiment, the first terminal to receive the video stream uncompresses it and sends it uncompressed to the additional terminals, Alternatively, each terminal receiving the stream decompresses it for presentation purposes, but transfers it in a compressed form. At step 516 a player, using a landbased gaming terminal is participating in the game taking place in the remotely located gaming room, and sees the captured and uncompressed video stream showing the game or the game manager, and the relevant information, such as a drawn card, the status of a roulette wheel or the like. At step 520, information entered by the player, such as actions, selections, sums or the like is transferred to the gaming room, such as gaming room 400 of FIG. 4, preferably through the game server. At the gaming room, the game manager receives the information and relates to it, if necessary. The loop continues until the player leaves the landbased gaming terminal at step 524. In an alternative embodiment of the present invention information entered by the player, such as actions, selections, sums or the like is transferred to the gaining room 400 of FIG. 4 via game server 404 of FIG. 4 only after game server 404 has performed an action on such information, such as for example to bill the player's credit card, to credit the player's credit card, to credit or charge the player's internal record for points or similar value associated credits, to provide a notification to a supervisor or another person, to send the user a notification or information, such as of his present credit, and the like.

The disclosed invention suggests a method and apparatus for enabling a user using a landbased gaming terminal to participate in a live online game. Using such terminal does not require a player to provide credit card details, nor to install gaming software on a computer. On the other hand, the online gaming terminals can be placed in multiple easily accessible locations such as gas stations, hotel lobbies, shopping malls or other locations and not necessarily in places that are dedicated to gaming, thus enabling an accidental passer by to participate in such games.

A person skilled in the art will appreciate that a microphone and loudspeakers can be installed or otherwise connected to the landbased gaming terminal, so that the game manager's voice will be transferred to the landbased gaming terminal with the image stream, and the player's voice will be transferred to the gaming room, so that the player can chat with the game manager or another person at the gaming location. It will also be appreciated that the image stream can be monitored or recorded, either at the gaming room, at the broadcast server or on other locations, for purposes such as quality assurance and fraud prevention.

The present invention has been described using non-limiting detailed descriptions of embodiments thereof that are provided by way of example and are not intended to limit the scope of the invention. It should be understood that features described with respect to one embodiment may be used with other embodiments and that not all embodiments of the invention have all of the features shown in a particular figure or described with respect to one of the embodiments. It is noted that some of the above described embodiments may describe the best mode contemplated by the inventors and therefore include structure, acts or details of structures and acts that may not be essential to the invention and which are described as examples.

The present invention is not limited to what has been particularly shown and described hereinabove. Structure and acts described herein are replaceable by equivalents, which perform the same function, even if the structure or acts are different, as known in the art. The scope of the present invention is defined only by the claims which follow. When used in the following claims, the terms "comprise", "include", "have" and their conjugates mean "including but not limited to".

The invention claimed is:

1. An apparatus capable of enabling participation in an at least one live online game, the apparatus comprising:

a. an at least one gaming room system configured to enable playing the at least one live online game; the at least one gaming room system comprising an at least one camera configured to capture an at least one captured image stream;

b. an at least one game server operatively coupled to the at least one gaming room system;

c. an at least one broadcasting server operatively coupled to the at least one camera and configured to transfer an at least one image stream, wherein the at least one image stream is the at least one captured image stream or a derivative thereof;

d. an at least one first landbased gaming terminal operatively coupled to the at least one game server and to the at least one broadcasting server, the at least one first landbased gaming terminal configured to be used by an at least one player to participate in the at least one live online game, and e. an at least one second landbased naming terminal operatively coupled to the at least one game server, the at least one second landbased gaming terminal configured to be used by an at least one player to participate in the at least one live online game and to exchange game-related commands with the at least one game server with no involvement of the first game terminal, wherein the at least one first landbased gaming terminal is configured to receive the at least one image stream transferred from the at least one broadcasting server and to transfer the received at least one image stream to the at least one second landbased gaming terminal, wherein the at least one second landbased gaming terminal is configured to receive the at least one image stream transferred from the at least one first landbased gaming terminal, and wherein the at least one broadband server is configured not to transfer the at least one image stream to the at least one second landbased gaming terminal.

2. The apparatus of claim 1, wherein the at least one second landbased gaming terminal is configured to receive the at least one image stream merely from the at least one first landbased gaming terminal.

3. The apparatus of claim 2, wherein the at least one second landbased gaming terminal and the at least one first landbased gaming terminal are hosted in the same physical location.

4. The apparatus of claim 1, wherein the at least one image stream is the encoded the at least one captured image stream, and wherein the at least one first landbased gaming terminal is configured to decode the at least one image stream before transferring to the at least one second landbased gaming terminal.

5. The apparatus of claim 1, wherein the at least one gaming room system further comprises an encoder operatively coupled to the at least one camera and configured to encode the at least one captured image stream before transferring to the at least one broadcasting server.

6. The apparatus of claim 1, wherein the at least one broadcasting server is configured to encode the at least one captured image stream before transferring to the at least first landbased gaming terminal.

7. The apparatus of claim 1, wherein the at least one image stream is the compressed the at least one captured image stream, and wherein the at least one first landbased gaming terminal is configured to de-compress the at least one image stream before transferring to the at least one second landbased gaming terminal.

8. The apparatus of claim 1, wherein the at least one gaming room system further comprises a compressing server operatively coupled to the at least one camera and configured to compress the at least one captured image stream before transferring to the at least one broadcasting server.

9. The apparatus of claim 1 wherein the at least one broadcasting server is configured to compress the at least one captured image stream before transferring to the at least first landbased gaming terminal.

10. The apparatus of claim 1, wherein the at least one gaming room system further comprises an equipment configured to computerize an at least one aspect of the live online game, and wherein the at least one first landbased gaming terminal and the at least one second landbased gaming terminal are configured to receive and present said at least one aspect of the live online game.

11. The apparatus of claim 10, wherein the equipment is a scanner.

12. A method of enabling participation in an at least one live online game, the method comprising:

a. obtaining an at least one captured image stream by capturing provided by at least one camera comprised in an at least one gaming room system;

b. transferring by an at least one broadcasting server at least one image stream to an at least one first landbased gaming terminal operatively coupled to an at least one game server, wherein the at least one image stream is the at least one captured image stream or a derivative thereof; and c. transferring by the at least one first landbased gaming terminal the at least one image stream to an at least one second landbased gaming terminal operatively coupled to the at least one game server and exchanging game-related commands with the at least one game server with no involvement of the first game terminal;

wherein the at least one broadcasting server does not transfer the at least one image stream to the at least one second landbased gaming terminal.

13. The method of claim 12, further comprising recording the at least one image stream before transferring by the at least one broadcasting server.

14. The method of claim 12, further comprising encoding the at least one captured image stream prior to receiving by the at least one first landbased gaming terminal, and decoding the at least one image stream by the at least one first landbased gaming terminal before transferring to the at least one second landbased gaming terminal.

15. The method of claim 14, wherein the encoding is provided by an encoder comprised in the at least one gaming room system.

16. The method of claim 14, wherein the encoding is provided by the at least one broadcasting server.

17. The method of claim 12, further comprising compressing the at least one captured image stream prior to receiving by the at least one first landbased gaming terminal, and decompressing the at least one image stream by the at least one first landbased gaming terminal before transferring to the at least one second landbased gaming terminal.

18. The method of claim 17, wherein the compressing is provided by an compressing server comprised in the at least one gaming room system.

19. The method of claim 17, wherein the compressing is provided by the at least one broadcasting server.

* * * * *